United States Patent [19]

Kobori et al.

[11] Patent Number: 4,964,246

[45] **Date of Patent: * Oct. 23, 1990**

[54] RIGIDITY CONTROL SYSTEM FOR VARIABLE RIGIDITY STRUCTURE

[75] Inventors: Takuji Kobori; Hiroo Kanayama; Shuichi Kamagata, all of Tokyo, Japan

[73] Assignee: Kajima Corporation, Tokyo, Japan

[ * ] Notice: The portion of the term of this patent subsequent to Jan. 24, 2006 has been disclaimed.

[21] Appl. No.: 319,657

[22] Filed: Mar. 6, 1989

[30] Foreign Application Priority Data

Mar. 7, 1988 [JP] Japan ..... 63-53068

[51] Int. Cl.[5] ..... E04B 1/98

[52] U.S. Cl. ..... 52/1; 52/167 R

[58] Field of Search ..... 52/1, 167

[56] References Cited

U.S. PATENT DOCUMENTS

| | | | |
|---|---|---|---|
| 3,232,012 | 2/1966 | Proctor | 52/1 |
| 3,538,653 | 11/1970 | Meckler | 52/1 |
| 4,429,496 | 2/1984 | Masri | 52/1 |
| 4,766,706 | 8/1988 | Caspe | 52/1 |
| 4,799,339 | 1/1989 | Kobori et al. | 52/1 |

FOREIGN PATENT DOCUMENTS

| | | | |
|---|---|---|---|
| 164520 | 8/1985 | Japan | 52/167 |

*Primary Examiner*—Richard E. Chilcot, Jr.
*Attorney, Agent, or Firm*—James H. Tilberry

[57] ABSTRACT

The present invention contemplates a rigidity control system for a variable rigidity structure incorporating variable rigidity elements, such as braces, for making the connecting condition with the frame variable between the locked and unlocked conditions for example, in which the vibration of a structure caused by external vibrational forces of an earthquake, wind or the like is attenuated by varying the rigidity of the structure. The rigidity control of the present invention imitates the tension and relaxation of a muscle in the self-balancing function of a living body. The vibrational condition of a frame is considered to be separately four conditions, i.e., the process of increasing the deformation in one direction, the process of decreasing the deformaton following thereafter, the process of increasing the deformation in the opposite direction and the process of decreasing the deformation following thereafter. Continuous responses are detected by sensors and the structure is set to be in the rigid condition in the deformation increasing process to restrain the excessive deformation of the building frame while the structure is set to be in the resilient condition in the deformation decreasing process to continuously vary the rigidity of the frame, whereby the resonance of the frame with seismic motion or the like is avoided to attenuate the vibration.

9 Claims, 5 Drawing Sheets

RIGIDITY CONTROL SYSTEM FOR VARIABLE RIGIDITY STRUCTURE

This invention relates to a rigidity control system for a variable rigidity structure. More particularly, the invention relates to a rigidity control system in which the deformation and the forces of deformation of a structure are detected with vibration detecting means provided in the structure. The rigidity of the structure is continuously varied according to the detected deformation and forces of deformation of the structure to thereby safely and logically cope with such forces caused by earthquake tremors or the like.

BACKGROUND OF THE INVENTION

Systems for varying the rigidity of a structure responsive to external forces, such as earthquake tremors, wind or the like, to provide for the safety of the structure, are known in the prior art. One example of a variable rigidity structure under automatic control is disclosed in Japanese Patent Publication No. Sho 49-46993. Another method for controlling a building against earthquake tremors is disclosed in U.S. Pat. No. 4,799,339, which is assigned to the assignee of this patent application.

According to Japanese Patent Publication No. Sho 49-46993, external forces against the structure are detected by a detector such as a strain meter. Control elements disposed in principal positions of the structure are extended or contracted to vary the rigidity of the structure. Thus the structure is maintained in a rigid condition to cope with high wind pressures, while the structure is maintained in a resilient condition to cope with horizontal forces produced by an earthquake. However, the rigidity of the structure can only be changed between rigid and resilient conditions. Accordingly, the rigidity of the structure cannot be controlled responsive to specific vibrational characteristics of an earthquake to accommodate the many uncertain forces of deformation on the structure.

The system of U.S. Pat. No. 4,799,339 has advantages over the Japanese patent in that it provides more flexible control over the rigidity of the structure responsive to the specific vibrational characteristics of individual earthquakes. However, the disadvantage of the 4,799,339 patent system is that it requires many rigidity device installations throughout the structure and complicated control systems to deal with the many uncertain elements of force characteristic of earthquakes.

SUMMARY OF THE INVENTION

The present invention contemplates a novel system to reduce the vibration of a structure caused by external vibrational forces such as earthquake tremors, wind or the like, by varying the rigidity of the structure with variable rigidity devices secured about the frame of a building.

According to the present invention, the phenomenon of vibration of building frames due to external vibrational forces is controlled by imitating the tension and relaxation of muscle in the self-balancing function of a living body. For purposes of analysis, the vibrational characteristics of a building frame may be divided into four conditions:

(a) the condition of increasing deformation in a first direction;

(b) the condition of decreasing deformation in the first direction following condition (a);

(c) the condition of increasing deformation in the opposite direction of condition (a); and (d) the condition of decreasing deformation in the opposite direction of condition (a) following condition (c).

In conditions (a) and (c) of increasing deformation, excessive deformation of the building frame is restrained by placing the structure in a rigid condition. In conditions (b) and (d) of decreasing deformation, resonance of the frame with seismic vibration is attenuated by setting the structure in a resilient condition and thereafter continuously varying the rigidity of the frame. However, if the deformation of the building frame is minimal, such as in the case of a slight earthquake, the attentuation property of the structure may be more effective if the structure is maintained in the rigid condition.

The variable rigidity devices include braces, quake-resisting walls, moment-resisting columns and beams and the like, comprising the frames of structures. Further, use may be made of a structure which varies a locked condition and an unlocked condition of the variable rigidity devices and a frame body. Use may also be made of a structure which varies the rigidity of the variable rigidity devices themselves, such as in the case where the braces or moment-resisting columns are utilized as the variable rigidity devices.

The rigidity control in accordance with the present invention is based on a feedback system for controlling the rigidity of a building in accordance with the rate of response of the building frame to external forces, including feedback of actual displacement, speed, acceleration and the like. Earthquake tremors, for instance, are detected by vibration sensors mounted on the frame of the building. Computer program means are provided to analyze building structure deformation as a function of time for comparison with conditions (a) through (d). The computer program means further determines whether the frame should be placed in a rigid condition or in a resilient condition and then selectively sends control signals to appropriate variable rigidity devices calculated to obtain the most effective condition of building rigidity or resilience commensurate with the forces imposed thereon.

When the variable rigidity device comprises a pair of cross braces in a building frame, including columns, beams, and tension control means for tensioning or relaxing these braces, the rigidity of the frame may be feedback controlled by selectively tensioning or relaxing these cross braces according to the aforementioned four conditions of deformation.

OBJECTS OF THE INVENTION

It is a primary object of the present invention to provide a building rigidity control system that is easy to manage.

It is another object of the invention to provide a rigidity control system in which the variation in the rigidity of a building is feedback-controlled responsive to the deformation of its frame.

It is yet another object of the present invention to reduce the vibrations of a structure caused by earthquake tremors or wind by means of a feedback control system.

It is still another object of the present invention to provide a rigidity control system which prevents resonance with external vibrational forces by lessening the rigidity of a structure responsive to sensed deformation thereof.

It is a further object of the present invention to provide a rigidity control system which facilitates the tensioning of a brace as a variable rigidity device.

It is a still further object of the present invention to provide a rigidity control system which achieves earthquake vibration control of a building by a system not achieved by prior art earthquake-resisting structures.

DETAILED DESCRIPTION OF A PREFERRED EMBODIMENT OF THE INVENTION

Figure 1:
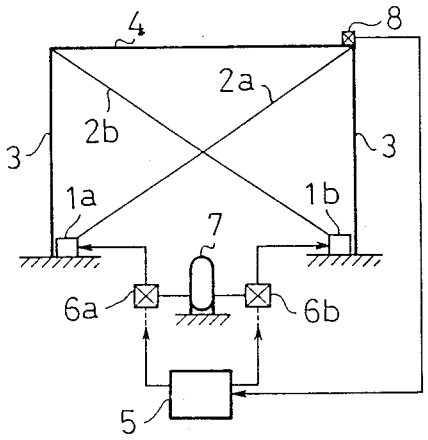
FIG. 1 is a schematic elevational sketch of a structure showing a rigidity control system according to the present invention.

FIG. 1 schematically illustrates a control system according to the present invention, in which cross braces 2*a*, 2*b* are disposed on diagonal lines in a frame 10 comprising columns 3 and beam 4. Each of the braces 2*a*, 2*b* is provided with corresponding control units 1*a*, 1*b* for selectively tensioning or releasing the tension of brace 2*a* and/or 2*b*.

Mounted on building frame 10 are sensors 8, including a displacement sensor and a speed sensor for detecting the extent of deformation of a frame deformed by external forces such as earthquake tremors or wind. Signals interpreting the conditions of deformation of the frame are relayed from these sensors to a control computer 5, which is programmed to operate the control units 1*a*, 1*b* responsive to these signals. The tensioning and release of tension of each of the braces 2*a*, 2*b* are controlled by the control units 1*a*, 1*b* to thereby vary the rigidity of the building.

The computer 5 controls the operation of each of the tension control units 1*a*, 1*b* and comprises deformation evaluation means and command generating means to actuate control units 1*a*, 1*b*.

Figures 2, 3, 4, 5:
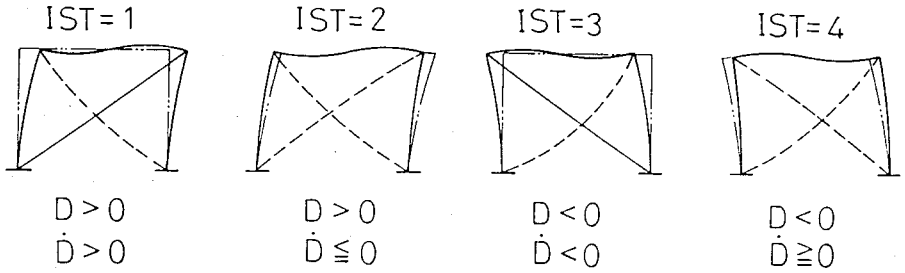
FIGS. 2 through 5 are elevational sketches showing the rigidity control system of a structure in each of four deformation stages of the structure.

FIGS. 2 through 5 schematically demonstrate deformation of the frame through a cycle of vibration. The deformation of the frame is divided into four sequential stages in the present invention as follows:

(a) increasing rate of deformation (see FIG. 2) in a first direction;

(b) decreasing rate of deformation (see FIG. 3) in a first direction;

(c) increasing rate of deformation (see FIG. 4) in the opposite direction; and (d) decreasing rate of deformation (see FIG. 5).

The control computer 5 determines whether the deformation of the frame at any given time is within any one of stages (a) through (d) pursuant to signals being continuously transmitted from sensor 8. Control computer 5 also determines which braces should be tensioned or tension-released. It then selectively feeds a tension signal or a tension-release signal to the control units 1*a*, 1*b* to control the rigidity of the frame responsive to the continuously changing deformation of the frame during a cycle of vibration.

The tension control units 1*a*, 1*b* may comprise state of the art hydraulic cylinders connected to the ends of the braces 2*a*, 2*b*. The position of the cylinder pistons may be shifted between two positions, i.e., contracted and extended, which varies the tensions in the braces 2*a*, 2*b* connected to the hydraulic cylinders. In the contracted positions the braces are placed in tension. In the extended positions the tensions in the braces are released. The materials and forms of the braces are not limited so long as they are sufficiently strong in tension to withstand tensioning forces acting on the braces. The hydraulic cylinders are controlled by signals sent from computer 5 to electro-hydraulic servo valves 6*a*, 6*b* connected with an accumulator 7 to open or close the valves 6*a*, 6*b*, which, in turn, actuate hydraulic cylinders 1*a* and 1*b*. Wires may be used for the braces 2*a*, 2*b*, which may be tensioned by winches or similar motor-driven means.

As for one example of a controlling method of the system according to the present invention, the brace 2*a* or brace 2*b* is set to be in the tension condition in the aforementioned processes (a), (c) of increasing the deformation to provide a high rigidity, thus preventing the frame from being deformed while it is set to be in the relaxed condition by releasing one of the tension control units 1*a* and 1*b* from tension in the processes (b), (d) of decreasing the deformation to provide a low rigidity, thus obviating the resonance with the external vibrational force.

The control mechanism as noted above is summarized in the following table. Further, if the speed $\dot{D}$ cannot be measured, the symbol of $\Delta D = D_{NEW} - D_{OLD}$ will suffice for the speed evaluation instead ($D_{OLD}$ corresponds to the displacement inputted one prior to $D_{NEW}$).

TABLE 1

| Vibration condition | IST = 1 | IST = 2 | IST = 3 | IST = 4 |
|---|---|---|---|---|
| Displacement D | $D > 0$ | $D > 0$ | $D < 0$ | $D < 0$ |
| Speed $\dot{D}$ | $\dot{D} > 0$ | $\dot{D} \leqq 0$ | $\dot{D} < 0$ | $\dot{D} \geqq 0$ |
| Control unit 1a | initial condition | tension release | to initial tension condition | |

TABLE 1-continued

| | | | | |
|---|---|---|---|---|
| Brace 2a | tension | tension → relaxation | relaxation | relaxation |
| Control unit 1b | to initial tension condition | | initial condition | tension release |
| Brace 2b | relaxation | relaxation | tension | tension → relaxation |

Figure 6:
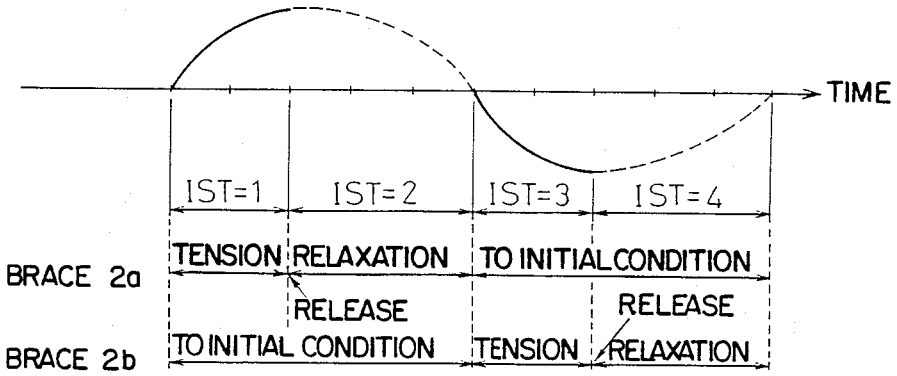
FIG. 6 is a sinusoidal curve showing deformation of a structure within one vibration cycle.

Also, FIG. 6 shows this control concept as the relationship between the vibration condition and the control in one vibrational cycle. The control wave form simulates the tension and relaxation of a muscle in the self-balancing function of a living body.

Figure 7:
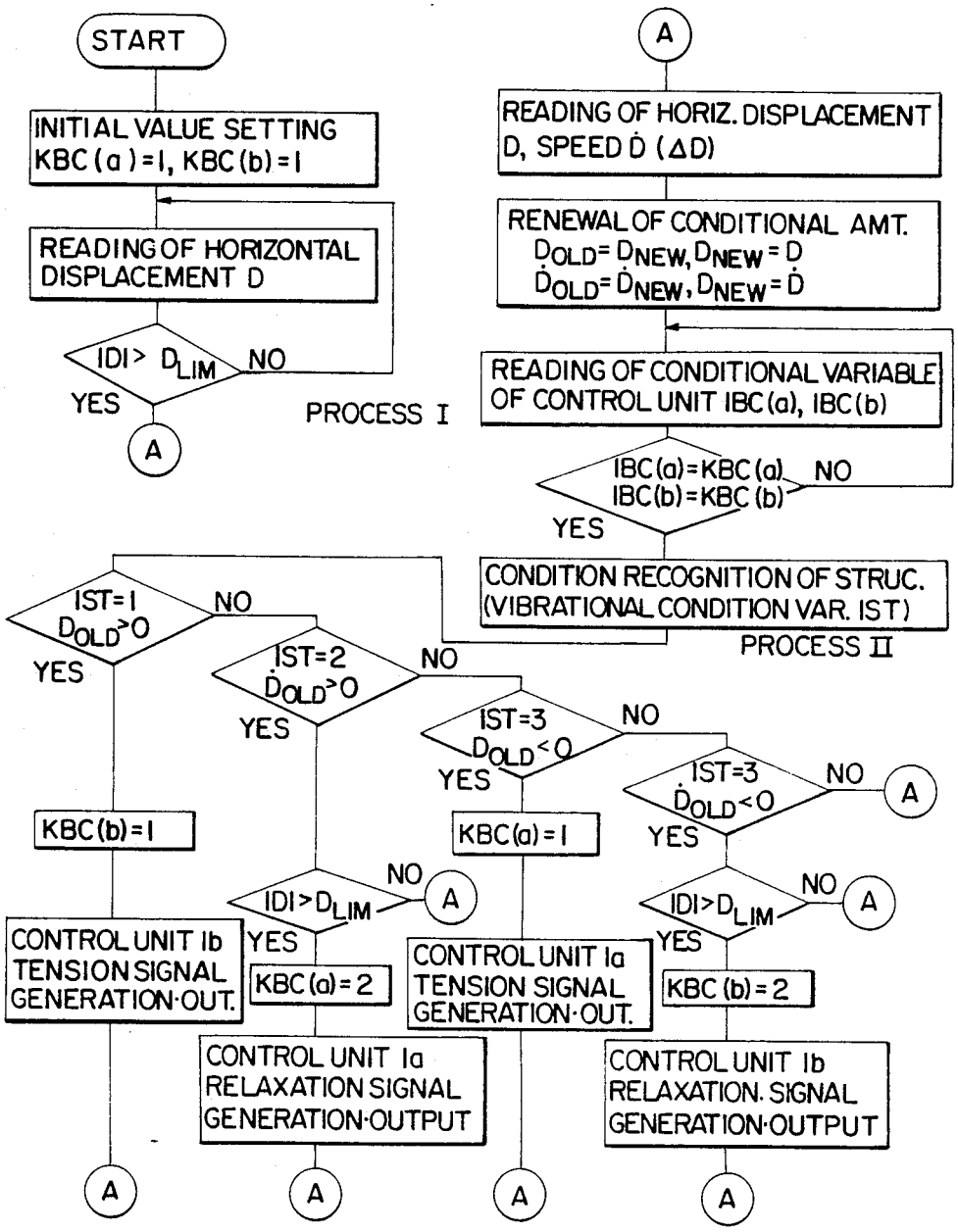
FIG. 7 is a flow chart showing a system of control for a frame by a control system according to the present invention.

Next, an example of a control program will be described with reference to FIG. 1 and flow chart FIG. 7.

(1) The occurrence of an earthquake is sensed by earthquake surveying sensors installed in earthquake surveying points and/or vibration sensors 8, FIG. 1, disposed in a building to start a program.

(2) KBC(a) and KBC(b) are considered as variables corresponding to the conditions of both control units 1*a*, 1*b* to tension 1 and to release the tension of 2, as for each of which an initial value of 1 is assigned.

(3) $D_{LIM}$ is previously given as a threshold value for control and the controlling operation is advanced when the absolute value $|D|$ of displacement D of the vibration sensor for the frame exceeds $D_{LIM}$.

(4) In process I, the actual condition of each of the control units 1*a*, 1*b* is read by a condition sensor provided in each of the control units 1*a*, 1*b* as IBC(a) and IBC(b) to be compared with KBC(a) and KBC(b) and then confirmed. When IBC(a)=KBC(a) and IBC(b)=KBC(b), it is confirmed that the control units 1*a*, 1*b* are in the initial condition or in the correct operating condition, so that advance may be made to the next step. When IBC(a) $\neq$ KBC(b) and IBC(b)$\neq$KBC(b), the control is set to the standby condition since the control units 1*a*, 1*b* do not reach predetermined conditions.

(5) Next, in process II, the actual vibrational condition of the frame is recognized as the vibrational condition variable IST by the displacement D and speed $\dot{D}$ or $\Delta D$ given from the vibration sensor 8.

(6) The control units 1*a*, 1*b* are to be controlled only when (a) IST=1 and $D_{OLD}<0$ (b) IST=2 and $\dot{D}_{OLD}>0$ (c) IST=3 and $D_{OLD}>0$ and (d) IST=4 and $\dot{D}_{OLD}<0$.

In the case of (b), the control unit 1*a* is released from tension, and it is returned to the initial tension condition at the period of (c). While in the case of (d), the control unit 1*b* is released from tension and it is returned to the initial tension condition at the period of (a). In the case other than the above, the next deformation D and speed $\dot{D}$ or $\Delta D$ are read, to repeat the above processes I, II. Further, in the case of (a) through (d), after generating the relaxation signal or tension signal, the next deformation D and speed $\dot{D}$ or $\Delta D$ are read to repeat the above processes I, II.

Further, after the control is started, in the cases of (b), (d), if $|d|<D_{LIM}$, the next deformation D and speed $\dot{D}$ or $\Delta D$ are read without generating any relaxation signal.

According to the above program, $|D|>D_{LIM}$ is obtained, and IST=1 is established by the first rightward deformation after the control is started. The requirements of IST=2($D_{NEW}>0$, $\dot{D}_{NEW}\geqq 0$) and $\dot{D}_{OLD}>0$ are satisfied by the continuous change, and when $|D|<D_{LIM}$, 2 is substituted in KBC(a) to release the control unit 1*a* from tension and generate the signal for relaxing the brace 2*a*. If $|D|>D_{LIM}$ is not obtained, the control unit is returned as it is, so that IST=3 is achieved by the leftward deformation to meet the requirement for IST=4 and $\dot{D}_{OLD}<0$. Also, when $|D|>D_{LIM}$ is obtained, 2 is substituted in KBC(b) to release the control unit 1*b* from tension and generate the signal of relaxing the brace 2*b*.

By releasing the control unit 1*a* from tension, IBC(a)=2 is sensed by the condition sensor to achieve IBC(a)=KBC(a) and then return the condition from the rightward deformation. When $D_{NEW}<0$, the condition is renewed to IST=3($D_{NEW}<0$, $\dot{D}_{NEW}<0$) in the process II and when $D_{OLD}<0$, 1 is substituted in KBC(a). Further, the requirement for $D_{OLD}<0$ represents the relaxed condition of the rightward rising brace 2*a* in the drawing and this condition is confirmed to return the control unit 1*a* to the position of its initial condition (tension condition). When the absolute value $|D|$ of rightward or leftward displacement exceeds $D_{LIM}$ hereinafter similarly, the control unit 1*a* or 1*b* is released from the tension and returned to the initial condition again in the process of relaxing each initial condition. When the absolute value $|D|$ of rightward or leftward displacement does not exceed $D_{LIM}$, the control unit is returned as it is since the tension is not released and then when $|D|>D_{LIM}$, the relaxation signal is fed to the control unit 1*a* or 1*b*.

Figure 8:
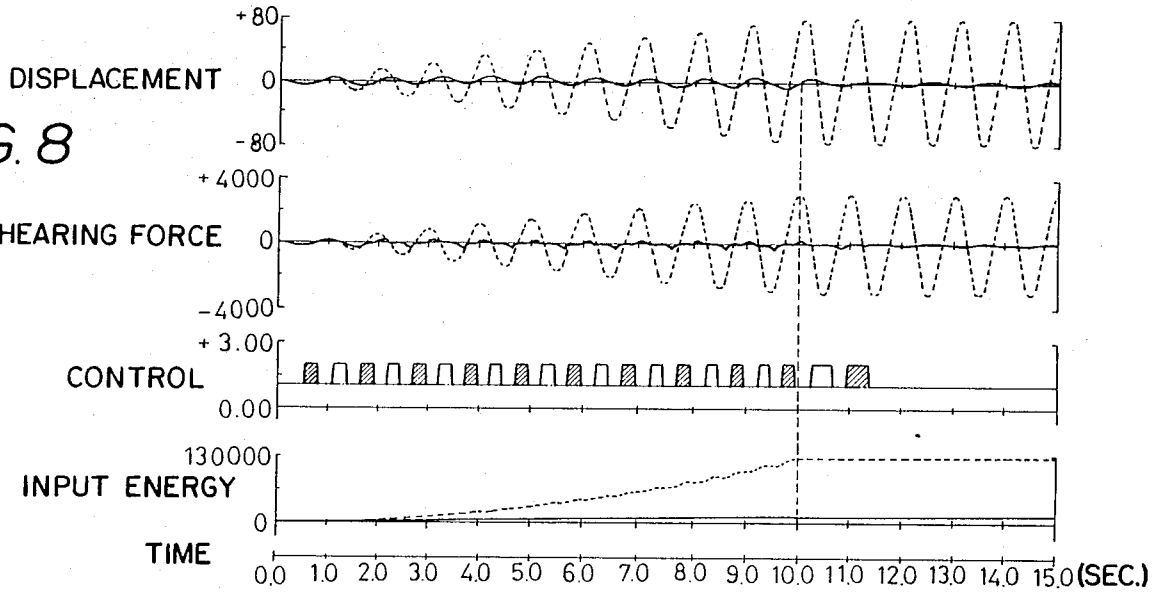
FIG. 8 is a graph on which displacement, shearing force, and energy input are plotted against time.
Figure 9:
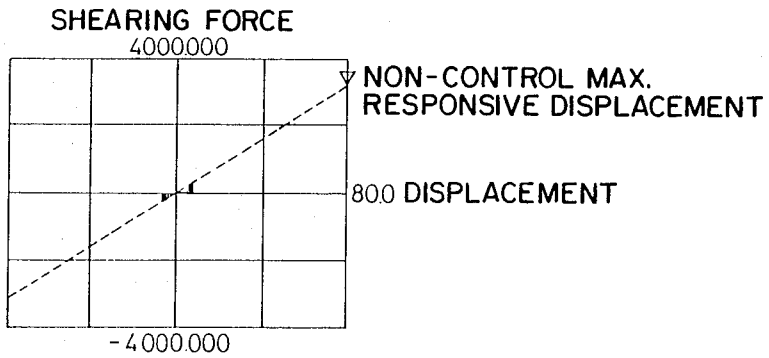
FIG. 9 is a chart showing the stability of a controlled structure subjected to the forces of FIG. 8.

FIG. 8 shows the result of simulation by numerical analysis, i.e., the time history of displacement, responsive shearing force, control condition and amount of input energy of the frame when a sine wave of 1 Hz is input. In FIG. 8, the dotted sine waves show the non-control condition while the solid square sine wave shows the condition controlled according to the present invention. The control on the side of the control unit 1*a* is shown by the cross hatching of the square sine wave plotted against time. FIG. 9 shows the instability of a structure which is not controlled as compared to the square sine wave of FIG. 8, showing a controlled structure according to the present invention.

Figure 10:
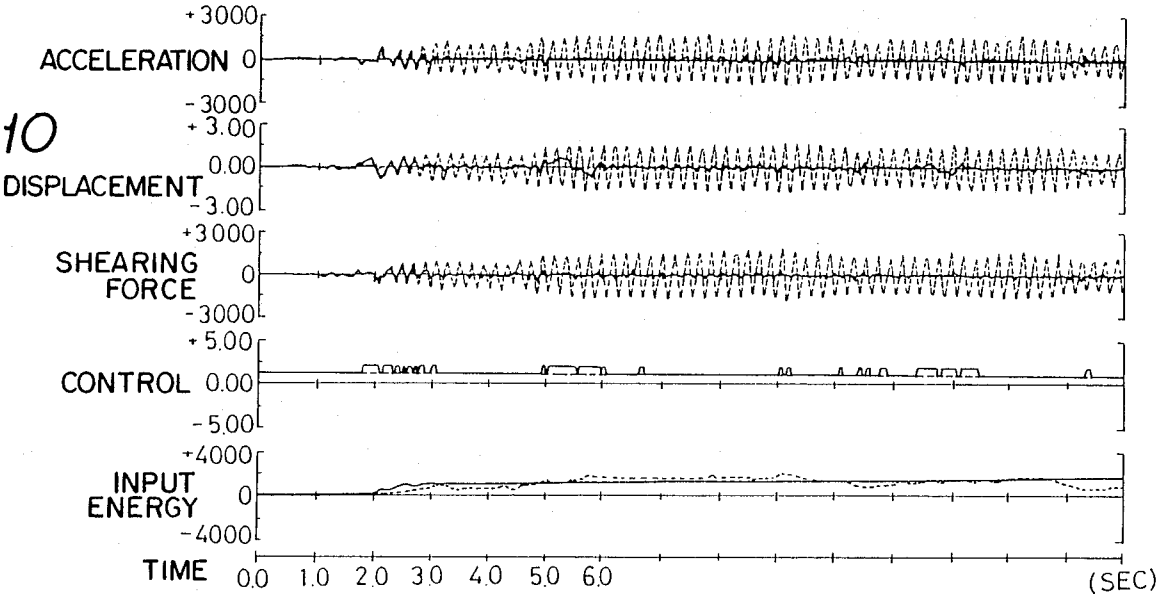
FIG. 10 is a graph showing acceleration, displacement, responsive shearing force, and amount of input energy of a frame plotted against time using values recorded in the Imperial Valley earthquake which occurred in 1940.
Figure 11:
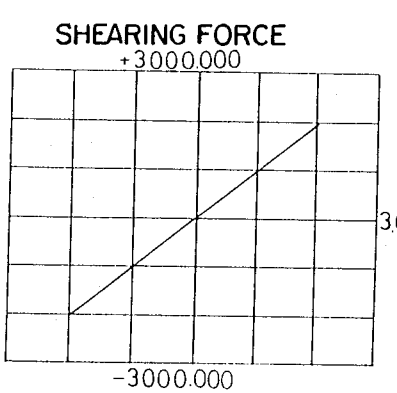
FIG. 11 is a chart showing the stability of a structure which is not controlled.
Figure 12:
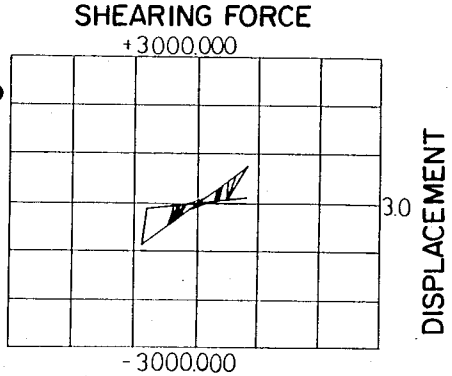
FIG. 12 is a chart showing the stability of a structure which is controlled.

FIG. 10 shows similarly the time history of the acceleration, displacement, responsive shearing force, control condition and amount of input energy of the frame when the Ercentro NS component in the Imperial Valley earthquake which occurred in 1940 is input as the seismic wave. FIG. 11 shows the instability of the structure which was not controlled and FIG. 12 shows the stability of the structure which was controlled.

Figure 13:
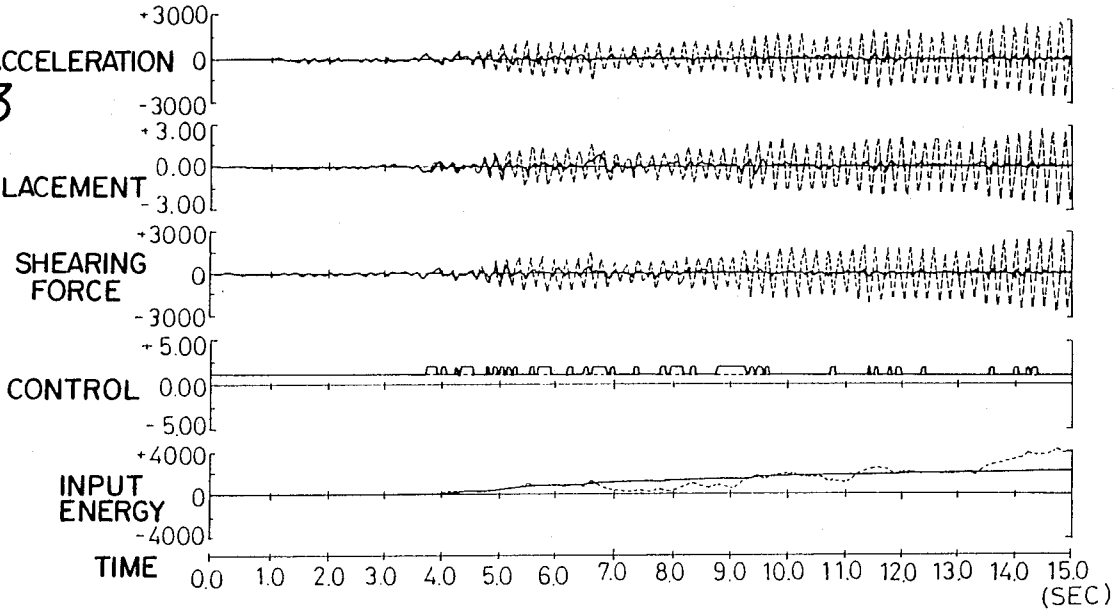
FIG. 13 is a graph showing acceleration, displacement, responsive shearing force, and amount of input energy of a frame plotted against time, using values recorded in the Keln County earthquake which occurred in 1952.
Figure 14:
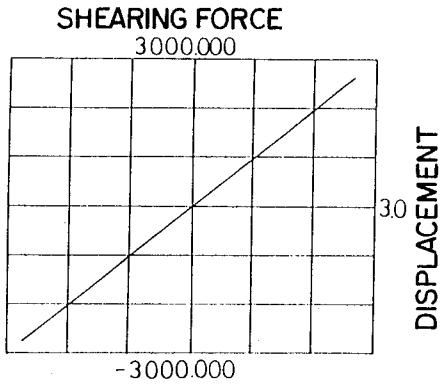
FIG. 14 is a diagram showing the stability of a structure which is not controlled.
Figure 15:
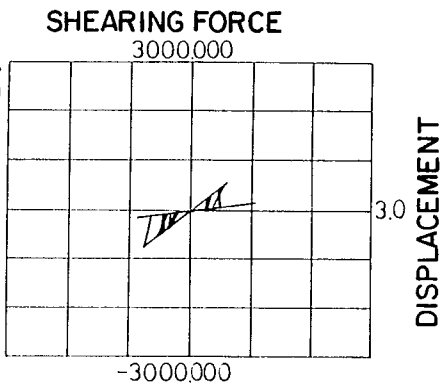
FIG. 15 is a diagram showing the stability of a structure which is controlled.

FIG. 13 shows similarly the time history of acceleration, displacement, responsive shearing force, control condition and amount of input energy of the frame when the Taft EW component in the Keln County earthquake which occurred in 1952 is input as seismic wave. FIG. 14 shows the instability of the structure which was not controlled and FIG. 15 shows the stability of the structure which was controlled.

It will occur to those skilled in the art, having read the described preferred embodiments of the invention and having read the specification in conjunction with a study of the drawings, that certain modifications may be made to the invention. However, it is intended that the invention only be limited by the scope of the appended claims.

What is claimed is:

1. A rigidity control system for variable rigidity structures subjected to deformation forces due to vibration comprising vibration detecting means to detect and to signal the deformation of a structure in a first direction, to detect the rate of deformation of a structure in first direction, to detect the deformation of a structure in a second direction, and to detect the rate of deformation of said structure in said second direction; structure rigidity control means, and control means responsive to said signals from said detecting means for generating actuating control signals to said structure rigidity control means to attenuate deformation causing vibrations.

2. The rigidity control system of claim 1, wherein said structure rigidity control means are adapted to selectively tension or relieve tension in said variable rigidity structure to attenuate deformation forces due to vibration.

3. The rigidity control system of claim 2 wherein said structure rigidity control means is selectively actuatable to variably resist forces of deformation responsive to the rate of change and direction of said deformation.

4. The rigidity control system of claim 2, wherein said structure rigidity control means comprises pairs of cables, each cable of each pair of cables being adapted to be selectively tensioned or released of tension.

5. The rigidity control system of claim 4, wherein when a first cable of a pair of cables is placed in tension, the second cable of said pair of cables is proportionately released of tension.

6. The rigidity control system of claim 4, wherein said structure rigidity control means is selectively actuatable to apply tension to said structure in opposition to said detected forces of deformation.

7. The rigidity control system of claim 4, wherein said structure rigidity control means is selectively actuatable to apply tension to said structure at a rate which is a function of the detected rate of deformation.

8. The rigidity control system of claim 4, wherein said structure rigidity control means is selectively actuatable to release tension in said structure responsive to a detected diminution of said detected forces of deformation.

9. The rigidity control system of claim 4, wherein said structure rigidity control means is selectively actuatable to release tension in said structure at a rate which is a function of the detected rate of diminution of said detected forces of deformation.

* * * * *